US006181064B1

(12) United States Patent
Narita

(10) Patent No.: US 6,181,064 B1
(45) Date of Patent: Jan. 30, 2001

(54) HIGH PRESSURE DISCHARGE LAMP

(75) Inventor: Mitsuo Narita, Himeji (JP)

(73) Assignee: Ushiodenki Kabushiki Kaisha, Tokyo (JP)

( * ) Notice: Under 35 U.S.C. 154(b), the term of this patent shall be extended for 0 days.

(21) Appl. No.: 09/310,344

(22) Filed: May 12, 1999

(30) Foreign Application Priority Data

May 12, 1998 (JP) ..... 10-128870

(51) Int. Cl.[7] ..... H01J 61/02
(52) U.S. Cl. ..... 313/623; 313/624; 313/570
(58) Field of Search ..... 313/623, 624, 313/625, 570, 571, 635, 318.02, 318.03

(56) References Cited

U.S. PATENT DOCUMENTS

| | | | | |
|---|---|---|---|---|
| 4,559,472 | * | 12/1985 | Triebel et al. | 313/623 |
| 4,673,843 | | 6/1987 | Okanuma . | |
| 5,128,588 | * | 7/1992 | Kameya et al. | 313/623 |
| 5,140,222 | * | 8/1992 | Roznerski | 313/623 X |
| 5,847,510 | * | 12/1998 | Goelling et al. | 313/623 |

FOREIGN PATENT DOCUMENTS

| | | |
|---|---|---|
| 197 05 763 | 1/1998 | (DE) . |
| 1102526 | 2/1968 | (GB) . |

* cited by examiner

*Primary Examiner*—Ashok Patel
(74) *Attorney, Agent, or Firm*—Nixon Peabody LLP; David S. Safran

(57) ABSTRACT

A high pressure discharge lamp in which, in the silica glass which comprises the hermetically sealed portion on the cathode side, fractures originating from the contact area with the cathode are prevented from propagating as in a high pressure discharge lamp of the direct current operating type which has: a discharge vessel of silica glass in which opposite sides an arc tube portion are each joined to a respective hermetically sealed portion; a metal foil is located in each of the hermetically sealed portions; a supply lead is attached in each the hermetically sealed portion with an inner end of the supply lead being connected to a respective one of the metal foils and an outer end projecting outwardly from the discharge vessel; an anode and a cathode are each attached in one of the hermetically sealed portions and have a base which is connected to one of the metal foils and a tip which projects into the arc tube portion; by the outer surface of the cathode-side hermetically sealed portion being surrounded by a conductive component in the area of the cathode, and by the area of the outer surface in which the conductive component is located having microscopically small projecting glass surfaces which do not contact the conductive component.

8 Claims, 1 Drawing Sheet

HIGH PRESSURE DISCHARGE LAMP

BACKGROUND OF THE INVENTION

1. Field of the Invention

The invention relates to a high pressure discharge lamp of the direct current operating type.

2. Description of the Related Art

The high pressure discharge lamp of the direct current operating type shown in FIG. 1 is known as a high pressure discharge lamp which is used, for example, for a light source in irradiation with UV radiation. Here, an discharge vessel 91 of fused silica glass has opposite sides of a arc tube portion 91C joined to hermetically sealed portions 91A and 91B. Furthermore, this lamp has a metal foil 92A which is inserted in the hermetically sealed portion 91A of the discharge vessel 91, and a metal foil 92B which is inserted in the hermetically sealed portion 91B of the discharge vessel 91. In addition, this lamp has a pin-shaped anode 93A and a pin-shaped cathode 93B. The anode 93A is attached in the hermetically sealed portion 91A with its base connected to the metal foil 92A, and its tip projecting into the arc tube portion 91C. Similarly, the cathode 93B is attached in the hermetically sealed portion 91B with its base connected to the metal foil 92B, and its tip projecting into the arc tube portion 91C. Still further, this lamp has a supply lead 94A and a supply lead 94B, the supply lead 94A being attached in the hermetically sealed portion 91A with its inner end connected to the metal foil 92A and its outer end projects outwardly from the discharge vessel 91, the supply lead 94B being attached in the hermetically sealed portion 91B with its inner end connected to the metal foil 92B and its outer end projecting outwardly from the discharge vessel 91.

In Japanese patent disclosure document SHO 61-263040 of the assignee of the present application, a technology is disclosed in which, in the above described high pressure discharge lamp of the direct current operating type, there are conductive components on the cathode side on the area of the outer surface of the hermetically sealed portion surrounding the metal foil and these components are used to maintain the hermetic property between the hermetically sealed portion (91B) on the cathode side and the metal foil (92B). In this technology, these conductive components are furthermore electrically connected to the metal foil.

In this technology, the electrical potential of the conductive component during lamp operation becomes the same as the electrical potential of the metal foil. In this way, a hermetic connection between the metal foil and the fused silica glass in the hermetically sealed portion is preserved.

However, in the high pressure discharge lamp known in the prior art, including the lamp described in the above described patent disclosure document, it is considered a disadvantage that the strength of the area of the fused silica glass which forms the discharge vessel and which is in contact with the pin-shaped cathode (the contact surface with the cathode rod and its vicinity) deteriorates over time as lamp operation continues and often fractures originate from this area.

Therefore, it is a good idea to prevent fractures originating from the contact area with the cathode rod and to improve the service life of the high pressure discharge lamp.

SUMMARY OF THE INVENTION

The invention was devised to eliminate the above described defect in the prior art. Thus, a primary object of the present invention is to provide a high pressure discharge lamp in which, in the silica glass which comprises the discharge vessel, no fractures arise originating from the contact area with the cathode.

As a result of dedicated research, the present inventor has found that the fractures in the silica glass of the discharge vessel that originate from the contact area with the cathode are based on the mechanism described below:

In lamp operation, cations which are present as impurities in the silica glass are sucked up by the cathode. Thus, they move and reach the contact area with the cathode. Due to these cations, micro cracks inevitably form in the contact area with the cathode, by which the silica glass in this contact area is adversely affected (strength is reduced). This is the main factor in the fractures originating from the contact area with the cathode.

The inventor has found that the movement of the cations in the silica glass in the hermetically sealed portion to the contact area with the cathode can be prevented and suppressed by the conductive component on the cathode side, over the entire area of the outside surface of the hermetically sealed portion surrounding the cathode, being in a state in which adhesion is not complete (i.e., in a state in which microscopically small glass surfaces project). The inventor has devised the invention based on this finding.

The object is achieved, in accordance with the invention, in a high pressure discharge lamp of the direct current operating type which comprises:

- a discharge vessel of silica glass in which opposite sides of an arc tube portion are joined to hermetically sealed portions;
- a metal foil which is inserted in the first hermetically sealed portion on the first side of the arc tube portion;
- an anode, which is attached to the first hermetically sealed portion which is located on the above described first side, has a base which is connected to the metal foil and a tip which projects into the arc tube portion;
- a supply lead is attached by the first hermetically sealed portion, which is located on the first side, has an inner end connected to the metal foil and an outer end which projects to the outside from the discharge vessel;
- a metal foil which is inserted in the hermetically sealed portion on the second side of the arc tube portion;
- a cathode, which is attached by the hermetically sealed portion which is located on the other second side, has a base which is connected to the metal foil and a tip which projects into the arc tube portion; and
- a supply lead, which is attached in the second hermetically sealed portion which is located on the second side, has an inner end connected to the metal foil and an outer end which projects to the outside from the discharge vessel;

wherein a conductive component completely encloses the outer surface of the second hermetically sealed portion on the second side in the area which surrounds the cathode, and in the area of the outer surface which this conductive component encloses, there are microscopically small glass surfaces which project on the outer surface but are not contacted by the at least one conductive component.

The object is furthermore advantageously achieved in accordance with the invention in a high pressure discharge lamp by the conductive component being made of metal wire with which the hermetically sealed portion on the second side is wound.

The object is furthermore advantageously achieved in a high pressure discharge lamp by the arc tube portion being filled with at least 0.13 mg/mm$^3$ mercury, rare gas and halogen and by the wall load being at least 0.8 W/mm$^2$.

The conductive component which is located in the area of the outer surface of the hermetically sealed portion of the discharge vessel and which surrounds the cathode (area which is adjacent to the arc tube) is irradiated with UV radiation from the arc tube portion.

Photoelectrons which are held on the microscopically small projecting glass surfaces and which are not contacted by the conductive component are emitted from the conductive component which was irradiated with UV radiation. In this way, the area of the outer surface of the second hermetically sealed portion (the area which surrounds the cathode) which is provided with conductive component is negatively charged. As a result, the cations in the silica glass are prevented and suppressed from being sucked up by the contact area with the cathode and from moving. Therefore, micro cracks present in this contact area are prevented from growing (the silica glass is prevented from being adversely affected).

Furthermore, the outer surface of the hermetically sealed portion is negatively charged using the photoelectrons which are emitted by the UV radiation from conductive component. Therefore, the effect of suppressing the motion of the cations to the contact area with the cathode can be obtained without the conductive component and the cathode being electrically connected to one another.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
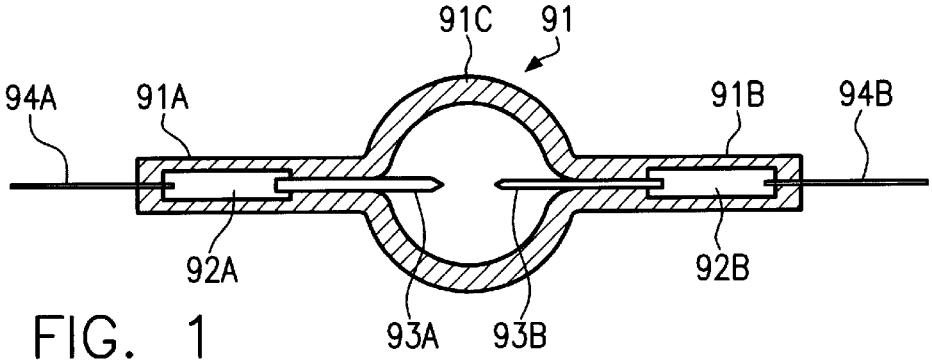
FIG. 1 (PRIOR ART)
FIG. 1 is a schematic cross section of a conventional high pressure discharge lamp.
Figure 2:
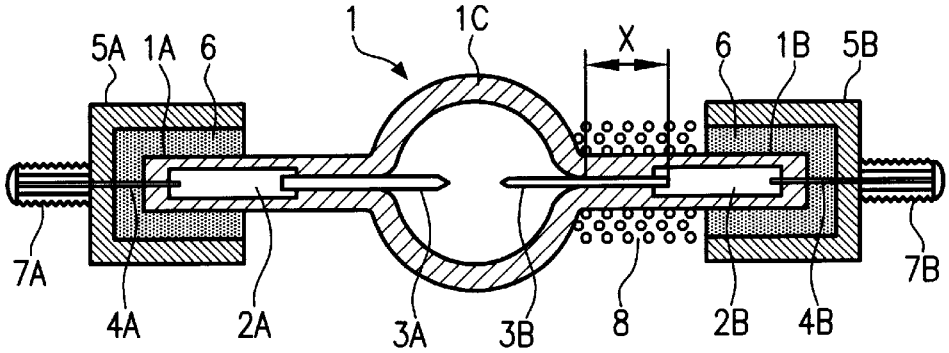
FIG. 2 is a schematic cross section of an embodiment of a high pressure discharge lamp in accordance with the invention.

The embodiment of a high pressure discharge lamp in accordance with the present invention shown in FIG. 2 has a fused silica glass arc tube which comprises arc tube portion 1C, a hermetically sealed portion 1A (on the anode side), a hermetically sealed portion 1B (on the cathode side), the hermetically sealed portions 1A and 1B being cylindrical and connected to the arc tube portion 1C.

As used herein, the phrase "hermetically sealed portion 1B on the cathode side" is defined as the area from the innermost side (the side towards the center) on which the fused silica glass of the arc tube is in contact with the cathode rod to the outer end of the discharge vessel on the cathode side.

In the hermetically sealed portion 1A on the anode side, a metal foil 2A is inserted to which the base of a rod-shaped anode 3A and the inner end of the supply lead 4A are each electrically connected.

In the hermetically sealed portion 1B on the cathode side, a metal foil 2B is inserted to which the base of a rod-shaped cathode 3B and the inner end of the supply lead 4B are each electrically connected.

The tip of the anode 3A and the tip of the cathode 3B face each other with a discharge gap therebetween in the arc tube portion 1C. The outer end of the supply lead 4A and the outer end of the supply lead 4B each project outwardly from the discharge vessel 1.

The metal foils 2A and 2B are made of molybdenum, for example. The anode 3A and cathode 3B are made, for example, of tungsten. The supply leads 4A and 4B are made, for example, of molybdenum.

Bases 5A and 5B are attached by means of an adhesive 6 on the outer surface of the end areas of the hermetically sealed portion 1A and the hermetically sealed portion 1B and are electrically connected via joining screws 7A and 7B to the supply lead 4A and supply lead 4B, respectively.

Here, the length of the discharge vessel 1 is 9 to 15 mm, the outside diameter of the arc tube portion 1C is 9 to 15 mm, the inside volume of the arc tube portion 1C is 0.05 to 1.0 cm$^3$, the outside diameter of the hermetically sealed portions 1A and 1B is 6 to 10 mm, and the length of the hermetically sealed portions 1A and 1B is 20 to 40 mm.

Furthermore, the length of the metal foils 2A and 2B is 10 to 30 mm, the diameter of the anode rod 3A is 0.4 to 3.0 mm, the length of the anode rod 3A is 8 to 22 mm, the diameter of the cathode rod 3B is 0.3 to 1.2 mm, the length of the cathode rod 3B is 7 to 15 mm, the distance between the anode rod 3A and the cathode rod 33 (i.e, discharge gap between their tips) is 0.8 to 2.0 mm, the diameter of the supply leads 4A and 4B is 0.5 to 1.0 mm, the length of the area of the outer surface surrounding the anode rod 3A in the hermetically sealed portion 1A is 3 to 8 mm and the length of the area of the outer surface X surrounding the cathode rod 3B in the hermetically sealed portion 1B is 3 to 8 mm.

Additionally, a conductive component 8 made of metal wire is wound about the outer surface of the hermetically sealed portion 1B. The metal wire forming the conductive component 8 can be, for example, a wire with thermal resistance such as Fe—Ni alloy wire, Fe—Cr alloy wire or the like. The diameter of this metal wire is, for example, 0.1 to 0.5 mm and the length of the metal wire which is necessary for winding the hermetically sealed portion 11B is 0.5 to 2 m.

In accordance with the invention, it is necessary that, in the area of the outer surface of the hermetically sealed portion that is surrounded by the conductive component, there are microscopically small glass surfaces which project from the outer surface and which are described below as retaining surfaces for photoelectrons.

By means of the metal wire conductive component 8 with which the hermetically sealed portion 1B is wound, microscopically small glass surfaces are necessarily formed which project from the outer surface; this is not the case in conductive components of the adhesive type which are made of metallic coating layers (conductive, metallic thin layers) or the like.

The conductive component 8 is located around the entire area X of the outer surface of the hermetically sealed portion 1B which surrounds the cathode 3B, and a part of the area of the outer surface thereof which surrounds the metal foil 2B (for example, by 5 to 50% of the outer surface area surrounding the metal foil 2B). As is apparent from the result of the embodiment described below, only by the arrangement of the conductive component over the entire area X of the outer surface which surrounds the cathode 3B can the fractures originating from the contact area with the cathode 3B be effectively prevented.

The arc tube portion 1C of the discharge vessel 1 is filled with mercury, rare gas and a halogen. Here, it is preferred that the amount of mercury added is greater than or equal to 0.13 mg/mm$^3$ in order to ensure sufficiently effective radiance in the arc part for the irradiation device.

The operating pressure of the arc tube portion 1C is greater than or equal to 100 atm. The rated power of this high pressure discharge lamp is 80 to 250 W. With respect to ensuring adequate vaporization of the mercury, it is preferred that the wall load be greater than or equal to 0.8 W/mm$^2$.

In a high pressure discharge lamp with the above described arrangement, in the fused silica glass comprising the discharge vessel 1, the fractures originating from the contact area with the cathode 3B can be prevented from expanding and use over a long time can be ensured.

In the following, the reason why the fractures originating from the contact area with the cathode 3B can be prevented from expanding is described using the drawings.

Figure 3:
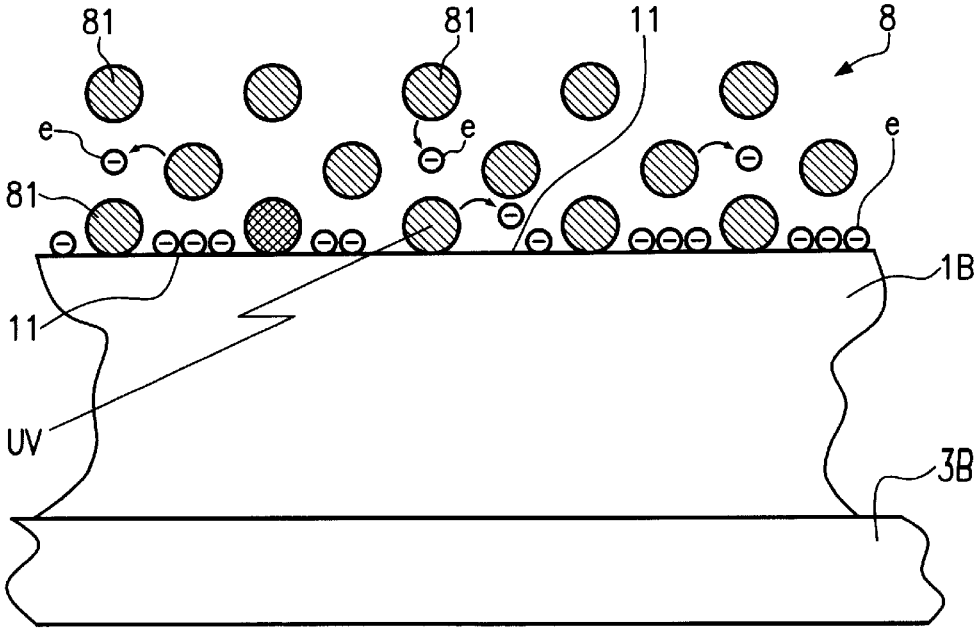
FIG. 3 is a schematic of the hermetically sealed portion on the cathode side in the high pressure discharge lamp of the invention.

FIG. 3 is a schematic of the hermetically sealed portion on the cathode side in the high pressure discharge lamp shown in FIG. 2.

In FIG. 3, a metal wire 81 comprises the conductive component 8. Furthermore, microscopically small, projecting glass surfaces 11 on the outer surface of the hermetically sealed portion 1B are surrounded by the metal wire 81 without being contacted thereby.

In lamp operation, the metal wire 81 comprising the conductive component 8 is irradiated with UV radiation from the arc tube portion. In this way, photoelectrons e are emitted from the metal wire 81 and are held on the microscopically small, projecting glass surfaces 11. In this way, the outer surface of the hermetically sealed portion 1B provided with the conductive component 8 is negatively charged. As a result thereof, the cations (not shown) in the fused silica glass forming the hermetically sealed portion 1B are sucked up by the outer surface. In this way, they are suppressed and prevented from moving towards the contact area with the cathode 3 in which micro cracks are present. Therefore, the fused silica glass in the contact area with the cathode is prevented from being adversely affected (i.e., the micro cracks are prevented from growing). Thus, fractures proceeding from this contact area can be reliably prevented.

Furthermore, the arrangement of the conductive component 8 (metal wire 81) in the area irradiated with UV radiation (outer surface area which is adjacent to the arc tube portion) uses the photoelectrons e emitted from the metal wire 81. Thus, the outer surface of the hermetically sealed portion 1B is negatively charged. Therefore, it is unnecessary to electrically connect the conductive component 8 of metal wire 81 and the cathode 3B to one another. This yields a simpler arrangement of a discharge lamp.

One example of the high pressure discharge lamp according to the invention was described above. The invention is however not limited thereto. For example, the modifications described below can be utilized.

(1) The a conductive component located in the outer surface area of the hermetically sealed portion can be made of a metal foil or metal plate. But here, it is necessary that microscopically small glass surfaces which project be present in the area provided with these conductive components. Therefore, it is necessary to loosely wind these conductive components partially in such a way that they float over the above described outer surface area. Further, more than one conductive component can be used.

(2) In the high pressure discharge lamp according to the invention, deterioration of the silica glass in the contact area with the cathode can be prevented even if the conductive components and the cathode are not electrically connected to one another. However, the conductive components and the cathode can be electrically connected to one another. In this way, an effect can be obtained which is the same or better than the effect in the above described prior art in Japanese patent disclosure document SHO 61-263040, while the object of the invention is not hindered.

EMBODIMENTS

Embodiment 1

Twenty super high pressure mercury lamps of the direct current operating type (high pressure discharge lamps in accordance with the invention) with the arrangement shown in FIG. 2 and the specifications described below were produced.

Length of the discharge vessel 1: 11 mm

Outside diameter of the arc tube portion 1C: 11 mm

Inside volume of the arc tube portion 1C: 0.1 cm$^3$

Outside diameter of the hermetically sealed portions 1A and 1B: 6 mm

Length of the hermetically sealed portions 1A and 1B: 30 mm

Length of the metal foils 2A and 2B: 25 mm

Diameter of the anode rod 3A: 0.8 mm

Length of the anode rod 3A: 11 mm

Diameter of the cathode rod 3B: 0.8 mm

Length of the cathode rod 3B: 10 mm

Distance between the electrodes (length of the arc): 1.5 mm

Diameter of the supply leads 4A and 4B: 0.8 mm

Length of the outer surface area X surrounding the cathode rod 3B: 5 mm

Type of metal wire comprising the conductive component 8: Fe—Cr alloy

Diameter of the metal wire comprising the conductive component 8: 0.3 mm

Thickness of the conductive component 8 (layer thickness of the metal wire): 1.0 mm Rated power: 150 W Amount of mercury added: 160 mg/mm$^3$ Wall load: 1.2 W/mm$^2$ Area where the conductive component 8 is wound: entire outer surface area X of 5 mm which surrounds the cathode rod 3B and part of the outer surface area of 5 mm which surrounds the metal foil 2B.

Embodiment 2

Besides the measure that the electrical components 8 and the cathode 3B were electrically connected to one another, the same measures as in embodiment 1 were implemented and 20 super high pressure mercury lamps of the direct current operating type (high pressure discharge lamp as claimed in the invention) were produced.

Comparison Example 1

Besides the measure that the outer surface area of the hermetically sealed portion 1B was not provided with the conductive components, the same measures as in embodiment 1 were implemented and 20 super high pressure mercury lamps of the direct current operating type (high pressure discharge lamps for comparison purposes) were produced.

Comparison Example 2

Besides the measure that instead of the arrangement of conductive components 8 consisting of metal wires, conductive metallic thin layers of platinum with a thickness of a few microns were formed as the coating, the same measures as in embodiment 1 were implemented and 20 super high pressure mercury lamps of the direct current operating type (high pressure discharge lamps for comparison purposes) were produced.

Comparison Example 3

Besides the measure that the conductive metallic thin layers and the cathode rod 3B were electrically connected to one another, the same measures as in embodiment 2 were implemented and 20 super high pressure mercury lamps of the direct current operating type (high pressure discharge lamps for comparison purposes) were produced.

Comparison Example 4

Besides the measure that the area where the conductive components 8 were placed surrounding the part of the outer surface area X (of 2 mm) which surrounds the cathode rod 3B and the entire area (of 25 mm) of the outer surface which surrounds the metal foil 2B, the same measures as in embodiment 1 were implemented and 20 super high pressure mercury lamps of the direct current operating type (high pressure discharge lamps for comparison purposes) were produced.

Evaluation of Lamps

In the respective super high pressure mercury lamps (5×20=100) which were obtained by embodiments 1 to 2 and comparison examples 1 to 3, an input lamp power 15% above the rated power (150 W) was used. A durability test was performed in which an on and off cycle with 5 minutes on and 5 minutes off was repeated 100 times. Thus, the number of lamps which broke during the test was measured. In the following the result is shown using Table 1.

TABLE 1

| | 1 | 2 | 3 | 4 |
|---|---|---|---|---|
| Embodiment 1 | metal wire | 5 | none | 0 |
| Embodiment 2 | metal wire | like 5 | present | 0 |
| Comparison example 1 | none | | | 19 |
| Comparison example 2 | metallized thin layer | like 5 | none | 18 |
| Comparison example 3 | metallized thin layer | like 5 | present | 7 |
| Comparison example 4 | metal wire | 6 | present | 3 |

1 - type of conductive component
2 - area where conductive components are placed
3 - electrical connection of conductive components to the cathode rod
4 - number of broken lamps
5 - entire area of the outer surface of the hermetically sealed portion which surrounds the cathode rod and part of the area of the outer surface of the hermetically sealed portion which surrounds the metal foil
6 - part of the area of the outer surface of the hermetically sealed portion which surrounds the cathode rod and entire area of the outer surface of the hermetically sealed portion which surrounds the metal foil It can be determined from the results shown in Table 1 that the super high pressure mercury lamps in embodiments 1 to 2 are lamps have high reliability can withstand use for a long time, while the super high pressure mercury lamps in comparison example 1, which are not provided with conductive components, and the superhigh pressure mercury lamps in comparison example 2, which are provided with conductive components (of the adhesion type) of conductive thin metallic layers, fractured greater than or equal to 90% and cannot be used over a long period.

Furthermore, the super high pressure mercury lamps in comparison example 3, which were provided with conductive components of conductive thin metallic layers which were electrically connected to the cathode rod, cannot withstand use over a long period.

Also, the super high pressure mercury lamps in comparison example 4, in which the entire area of the outer surface which surrounds the cathode rod was not provided with conductive components do not have sufficiently high reliability (in three, i.e., 15%, of lamps in comparison example 4, fractures in the fused silica glass occurred proceeding from the contact area with the cathode rod).

ACTION OF THE INVENTION

According to the invention, a high pressure discharge lamp with high reliability and long service life is provided in which fractures in the silica glass proceeding from the contact area with the cathode can be reliably prevented.

What we claim is:

1. High pressure discharge lamp of the direct current operating type which comprises:

a discharge vessel made of silica glass having an arc tube portion and a hermetically sealed portion joined to each of opposite sides of the an arc tube portion;

a metal foil which is disposed in each of the hermetically sealed portions;

a respective supply lead attached to an inner end of the metal foil in each of the hermetically sealed portions, an outer end of which projects outwardly from the discharge vessel;

an anode and a cathode, each of which is attached in a respective one of the hermetically sealed portions, has a base which is connected to a respective one of the metal foils, and a tip which projects into the arc tube portion;

wherein an outer surface of a cathode-side one of the hermetically sealed portions in an area which surrounds the cathode is completely surrounded with a conductive component; and wherein the area of the outer surface which is surrounded by said conductive component has microscopically small projecting glass surfaces on the outside surface of the cathode-side hermetically sealed portion, the projecting glass surfaces being out of contact with said conductive component.

2. High pressure discharge lamp as claimed in claim 1, wherein the conductive component is made of metal wire and is wound around the cathode-side hermetically sealed portion.

3. High pressure discharge lamp as claimed in claim 2, wherein the metal wire is made of Fe—Cr alloy or Fe—Ni alloy.

4. High pressure discharge lamp as claimed in claim 1, wherein the conductive component is made of metal foil or metal plate which is wrapped around the cathode-side hermetically sealed portion.

5. High pressure discharge lamp as claimed in claim 1, wherein the arc tube portion is filled with at least 0.13 $mg/mm^3$ mercury, rare gas and halogen; and wherein the wall load is at least equal to 0.8 $W/mm^2$.

6. High pressure discharge lamp as claimed in claim 2, wherein the arc tube portion is filled with at least 0.13 $mg/mm^3$ mercury, rare gas and halogen; and wherein the wall load is at least equal to 0.8 $W/mm^2$.

7. High pressure discharge lamp as claimed in claim 3, wherein the arc tube portion is filled with at least 0.13 mg/mm$^3$ mercury, rare gas and halogen; and wherein the wall load is at least equal to 0.8 W/mm$^2$.

8. High pressure discharge lamp as claimed in claim 4, wherein the arc tube portion is filled with at least 0.13 mg/mm$^3$ mercury, rare gas and halogen; and wherein the wall load is at least equal to 0.8 W/mm$^2$.

* * * * *